US010808652B2

(12) United States Patent
Kamoshida et al.

(10) Patent No.: US 10,808,652 B2
(45) Date of Patent: Oct. 20, 2020

(54) EGR APPARATUS AND DUMP TRUCK INCLUDING THE SAME

(71) Applicant: Komatsu Ltd., Minato-ku, Tokyo (JP)

(72) Inventors: Yasuhiro Kamoshida, Tokyo (JP); Tatsuya Iwazaki, Tokyo (JP); Makoto Watanabe, Tokyo (JP); Tomohiro Horiuchi, Tokyo (JP)

(73) Assignee: Komatsu Ltd., Tokyo (JP)

( * ) Notice: Subject to any disclaimer, the term of this patent is extended or adjusted under 35 U.S.C. 154(b) by 174 days.

(21) Appl. No.: 15/501,123

(22) PCT Filed: Sep. 26, 2016

(86) PCT No.: PCT/JP2016/078288
§ 371 (c)(1),
(2) Date: Feb. 1, 2017

(87) PCT Pub. No.: WO2017/034043
PCT Pub. Date: Mar. 2, 2017

(65) Prior Publication Data

US 2018/0087477 A1 Mar. 29, 2018

(51) Int. Cl.
*F02M 26/41* (2016.01)
*F02M 26/32* (2016.01)
(Continued)

(52) U.S. Cl.
CPC ..... *F02M 26/41* (2016.02); *F02M 26/05* (2016.02); *F02M 26/21* (2016.02); *F02M 26/23* (2016.02);
(Continued)

(58) Field of Classification Search
CPC ..... F02M 26/05; F02M 26/21; F02M 26/23; F02M 26/28; F02M 26/30; F02M 26/32; F02M 26/41
See application file for complete search history.

(56) References Cited

U.S. PATENT DOCUMENTS 4,980,588 A * 12/1990 Ogawa ..... H02K 9/19 123/41.31
5,970,960 A * 10/1999 Azuma ..... F02M 35/10222 123/568.12
(Continued)

FOREIGN PATENT DOCUMENTS

CN 102959225 3/2013
DE 112011105087 7/2014
(Continued)

OTHER PUBLICATIONS

International Search Report and Written Opinion in International Application No. PCT/JP2016/078288, dated Nov. 22, 2016, 9 pages, Japanese only.
(Continued)

*Primary Examiner* — Carl C Staubach
(74) *Attorney, Agent, or Firm* — Fish & Richardson P.C.

(57) ABSTRACT

An EGR apparatus configured to circulate exhaust gas discharged from an exhaust manifold of an engine to an intake manifold of the engine includes: an EGR cooler disposed at a downstream side of the exhaust manifold and configured to cool the exhaust gas discharged from the exhaust manifold; a pair of EGR valves disposed at an upstream side from the intake manifold and configured to adjust an amount of the exhaust gas to be supplied to the intake manifold; and an exhaust gas connector that establishes communication between the EGR cooler and the exhaust manifold, in which the exhaust gas connector includes a cooling water path to which cooling water for cooling the exhaust gas flowing inside the exhaust gas connector is supplied.

3 Claims, 14 Drawing Sheets

(51) Int. Cl.

| | |
|---|---|
| ***F02M 26/30*** | (2016.01) |
| ***F02M 26/05*** | (2016.01) |
| ***F02M 26/28*** | (2016.01) |
| ***F02M 26/21*** | (2016.01) |
| ***F02M 26/23*** | (2016.01) |

(52) U.S. Cl.
CPC ..... *F02M 26/28* (2016.02); *F02M 26/30* (2016.02); *F02M 26/32* (2016.02)

(56) References Cited

U.S. PATENT DOCUMENTS

| | | | | |
|---|---|---|---|---|
| 6,173,701 | B1 | 1/2001 | Azuma | |
| 9,581,107 | B2 * | 2/2017 | Kuroyanagi | F28F 9/02 |
| 10,100,787 | B2 * | 10/2018 | Jin | F28D 21/0003 |
| 2002/0035980 | A1 * | 3/2002 | Itoh | F02B 67/00 123/195 A |
| 2003/0197437 | A1 * | 10/2003 | Horioka | H02K 11/046 310/68 D |
| 2004/0104630 | A1 * | 6/2004 | Denner | B60K 6/40 310/75 R |
| 2005/0005893 | A1 * | 1/2005 | Ito | F01L 1/024 123/195 C |
| 2007/0000472 | A1 * | 1/2007 | Gong | F02B 19/1023 123/274 |
| 2013/0019848 | A1 * | 1/2013 | Noguchi | F02M 26/39 123/568.12 |
| 2017/0009639 | A1 * | 1/2017 | Mitsuda | F01N 3/106 |

FOREIGN PATENT DOCUMENTS

| | | |
|---|---|---|
| GB | 2451862 | 2/2009 |
| JP | H10-089160 | 4/1998 |
| JP | 2005-055064 | 3/2005 |
| JP | 2006-307759 | 11/2006 |
| JP | 2007-291948 | 11/2007 |
| JP | 2008-255970 | 10/2008 |
| WO | WO 2012/127535 | 9/2012 |

OTHER PUBLICATIONS

Office Action in German Application No. 11 2016 000 073.1, dated Aug. 1, 2017, 9 pages, with English translation.
International Preliminary Report on Patentability in International Application No. PCT/JP2016/078288, dated Mar. 26, 2019, 7 pages.
Chinese Office Action in Chinese Application No. 2016800021768, dated Jan. 21, 2019, 7 pages with English Translation.

* cited by examiner

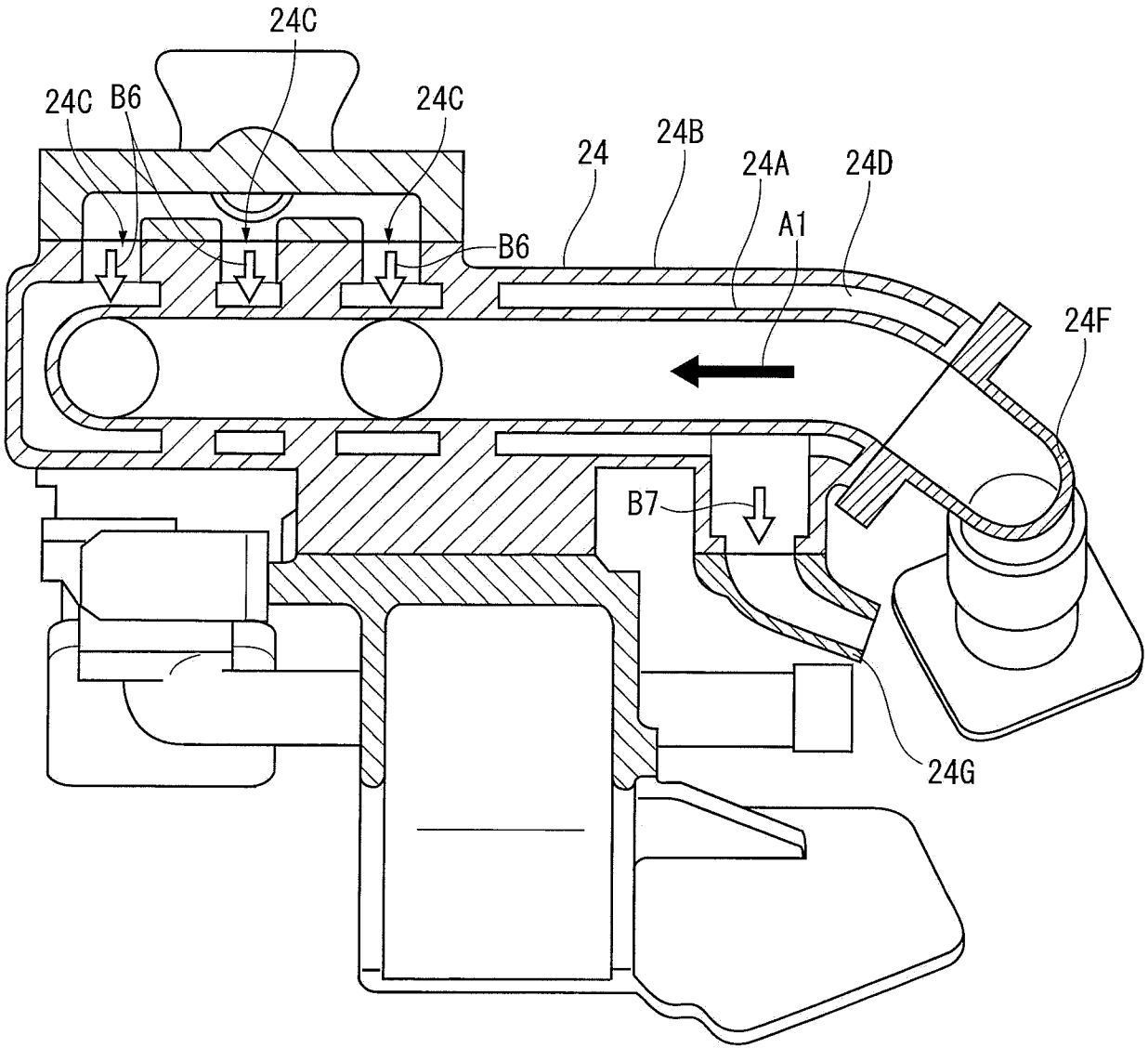
FIG. 12
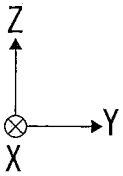

EGR APPARATUS AND DUMP TRUCK INCLUDING THE SAME

CROSS-REFERENCE TO RELATED APPLICATIONS

This application claims priority to International Application No. PCT/JP2016/078288 filed on Sep. 26, 2016, the contents of which are incorporated herein in their entirety.

TECHNICAL FIELD

The present invention relates to an Exhaust Gas Recirculation (EGR) apparatus and a dump truck including the EGR apparatus.

BACKGROUND ART

Heretofore, an EGR apparatus configured to lower a combustion temperature of a diesel engine to restrain generation of NOx has been known. The EGR apparatus is configured to recirculate a part of exhaust gas from an engine to an intake side. The EGR apparatus is occasionally provided with an EGR cooler to cool the exhaust gas to be recirculated.

For instance, each of Patent Literatures 1 and 2 discloses a structure as follows. An EGR apparatus is provided outside a V-shaped engine, so that exhaust gas discharged from left and right exhaust manifolds is joined together in a V bank of the V-shaped engine, cooled by an EGR cooler disposed in the V bank, and recirculated to intake manifolds.

CITATION LIST

Patent Literature(S)

Patent Literature 1: JP-A-2007-291948
Patent Literature 2: JP-A-2008-255970

SUMMARY OF THE INVENTION

Problem(s) to be Solved by the Invention

According to the structure disclosed in each of the above Patent Literatures 1 and 2, the exhaust gas discharged from the left and right exhaust manifolds is joined together and cooled by a single EGR cooler.

However, when an amount of the exhaust gas discharged from the V-shaped engine is increased, it is necessary to improve a cooling capacity, and therefore it is necessary to enlarge the size of the EGR cooler. Accordingly, it becomes difficult to house the EGR cooler in the V bank.

An object of the invention is to provide an EGR apparatus with a minimum size capable of being attached on an engine and having high cooling efficiency, and a dump truck including the EGR apparatus.

Means for Solving the Problem(s)

An EGR apparatus of the invention that is configured to circulate exhaust gas discharged from an exhaust manifold of an engine to an intake manifold of the engine includes: an EGR cooler disposed at a downstream side from the exhaust manifold and configured to cool the exhaust gas discharged from the exhaust manifold; an EGR valve disposed at an upstream side from the intake manifold and configured to adjust an amount of the exhaust gas to be supplied to the intake manifold; and an exhaust gas connector that establishes communication between the EGR cooler and the exhaust manifold. The exhaust gas connector includes a cooling water path to which cooling water for cooling the exhaust gas flowing inside the exhaust gas connector is supplied.

In the above arrangement, the exhaust gas connector is preferably supplied with cooling water having passed through the EGR cooler.

In the above arrangement, it is preferable that the EGR apparatus further includes a bracket used to attach the EGR apparatus to the engine. Preferably, the bracket includes a cooling water path into which cooling water having passed through the EGR cooler is supplied, and the exhaust gas connector is supplied with the cooling water having passed through the bracket.

An EGR apparatus of the invention that is attached to a V-shaped engine provided with a pair of left and right cylinder lines and configured to circulate exhaust gas discharged from exhaust manifolds of the V-shaped engine to intake manifolds of the V-shaped engine includes: a pair of EGR coolers disposed at a downstream side of the respective exhaust manifolds of the pair of cylinder lines and configured to cool the exhaust gas discharged from the exhaust manifolds; a pair of EGR valves disposed at an upstream side of the respective intake manifolds of the pair of cylinder lines and configured to adjust an amount of the exhaust gas to be supplied to the intake manifolds; and a pair of exhaust gas connectors that establish communication between the EGR coolers and the exhaust manifolds. Each of the exhaust gas connectors includes a cooling water path to which cooling water for cooling the exhaust gas flowing inside the exhaust gas connector is supplied.

A dump truck of the invention includes any one of the above-described EGR apparatuses.

In the above arrangement, the EGR apparatus is preferably sized to be within a projection plane of the engine as viewed from the above.

BRIEF DESCRIPTION OF DRAWING(S)

FIG. 12 is a cross-sectional view illustrating an exhaust gas connector taken along a line C-C in FIG. 11.

DESCRIPTION OF EMBODIMENT(S)

Exemplary embodiment(s) of the invention will be described below with reference to the attached drawings.

1. Overall Structure of Dump Truck 1

Figure 1:
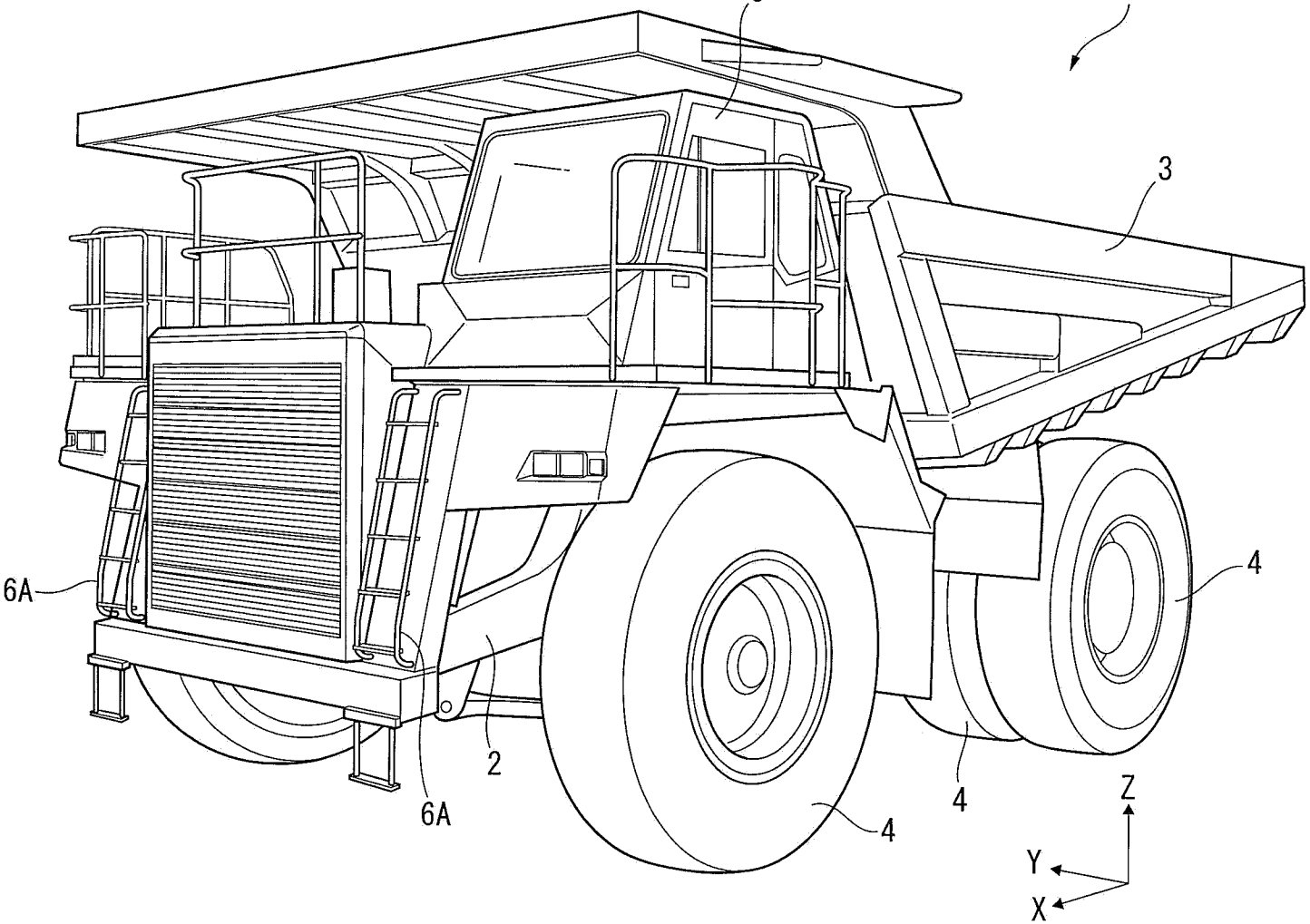
FIG. 1 is a perspective view illustrating a dump truck according to an exemplary embodiment of the invention.
Figure 2:
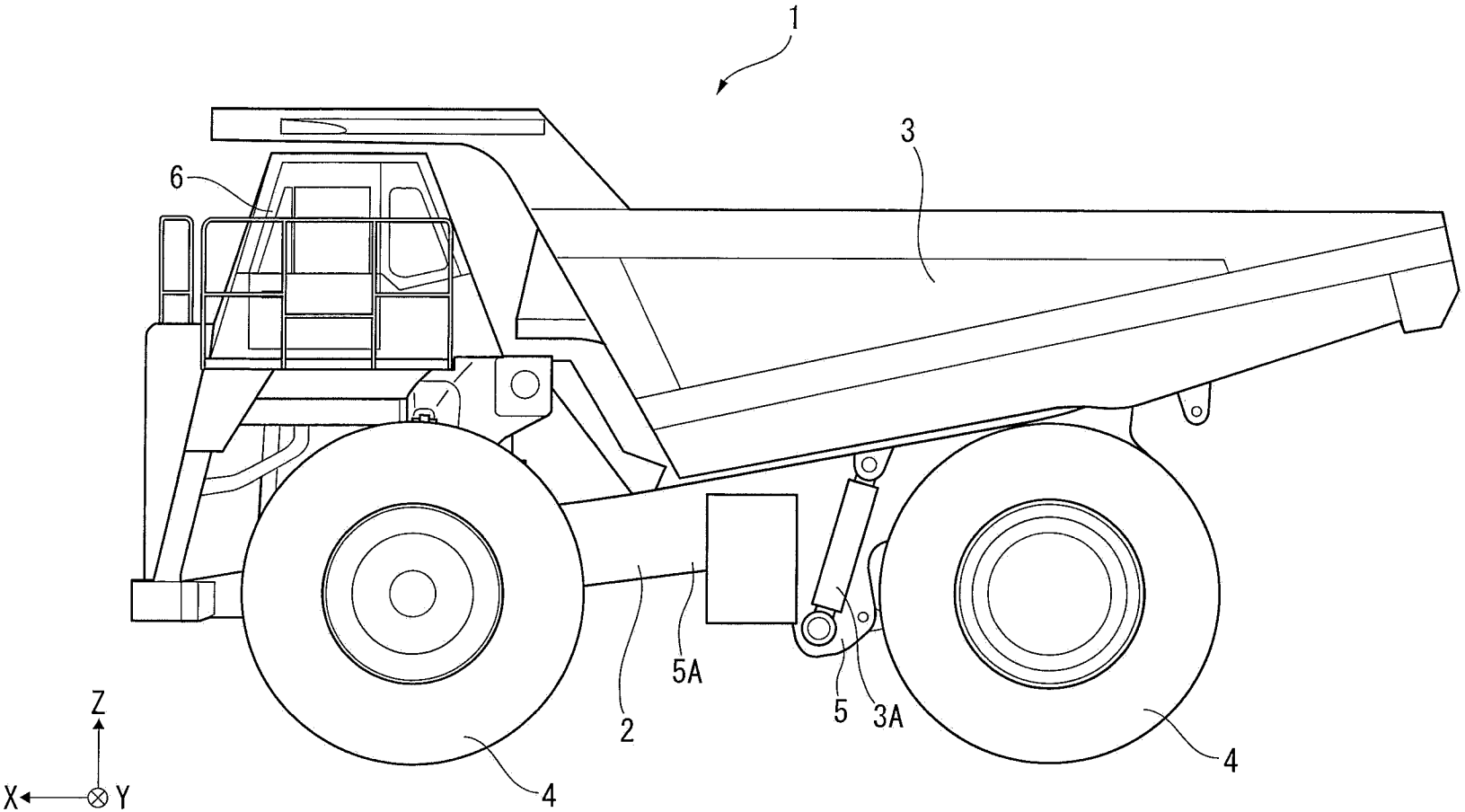
FIG. 2 is a side elevational view illustrating the dump truck according to the exemplary embodiment.

FIGS. 1 and 2 illustrate a dump truck 1 of an exemplary embodiment of the invention. FIG. 1 is a perspective view of the dump truck 1 as viewed from above. FIG. 2 is a side view of the dump truck 1 as viewed in a width direction perpendicular to a travel direction thereof.

It is to be noted that an X axis, a Y axis and a Z axis are perpendicular to each other in each figure according to the exemplary embodiment. According to the exemplary embodiment, for the purpose of illustration, FIG. 1 is taken as a standard view, in which an advancing direction of the dump truck 1 represents a direction indicated by an arrow oriented in the X axis, a vehicle-width direction of the dump truck 1 from left to right represents a direction indicated by an arrow oriented in the Y axis, and an upward vertical direction with respect to the ground represents a direction indicated by an arrow oriented in the Z axis. Further, in the below exemplary embodiments, sometimes, the travel direction is referred to as "front", the direction opposite to the travel direction is referred to as "back (rear)", the vehicle-width direction toward the right is referred to as "right" and the vehicle-width direction toward the left is referred to as "left".

The dump truck 1 is a working vehicle configured to convey loaded substances such as earth and sand at a dig site in a mine or the like, and includes a chassis 2 and a dump body 3.

The chassis 2 is supported by a plurality of tires 4 through a suspension. The tires 4 are provided on both ends in the vehicle-width direction and arranged along the travel direction. A rear end of the dump truck 1 is provided with two tires 4, i.e., double tires on both ends in the vehicle-width direction.

The chassis 2 includes a frame 5. The frame 5 has a pair of side members 5A and a pair of side members 5B extending along edges in a width direction of the frame 5 (see FIG. 5), and a plurality of cross members 5C and 5D extending along the vehicle-width direction, the cross members 5C connecting the pair of side members 5A, the cross members 5D connecting the pair of side members 5B (see FIG. 4).

A dump body 3 is attached to the back of the chassis 2 through a hinge (not shown in the drawing) so that the dump body 3 can move up and down. A cab 6 as a driver seat is provided at the front left side above the the chassis 2. The cab 6 may be provided above the center of the chassis 2 in the width direction.

The dump body 3 has a rectangular loading space, and is attached to the chassis 2 so as to be revolvable about the hinge. The dump body 3 moves up and down with respect to the chassis 2 when hoist cylinders 3A each provided at the rear portion of the chassis 2 extend and retract so as to discharge the loaded substances such as earth and sand.

As shown in FIG. 1, the cab 6 functions as a driver seat for an operator to get on and drive the dump truck 1. The operator goes up and down a ladder 6A provided to the front side of the dump truck 1 so as to get on and off the cab 6.

Figure 3:
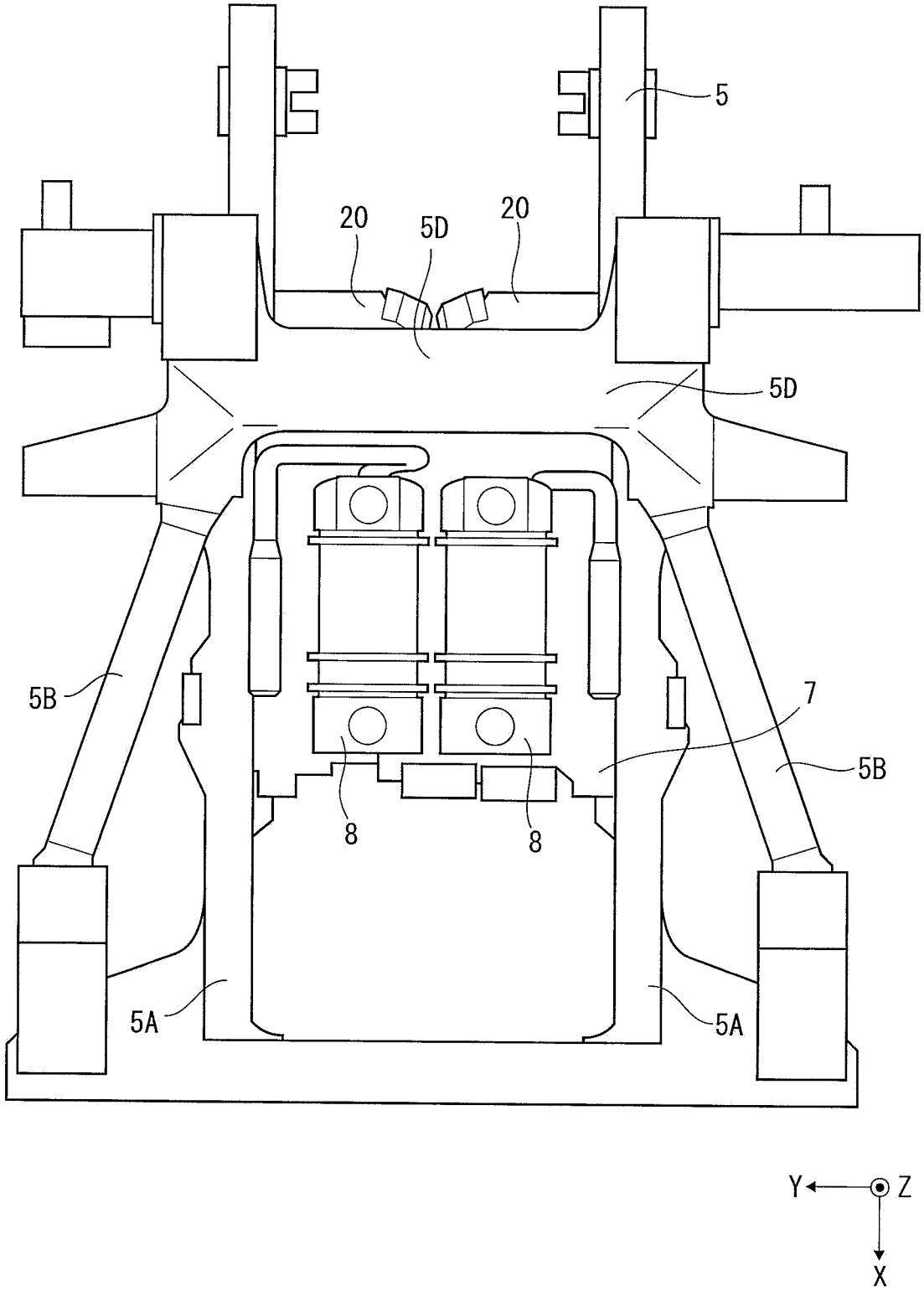
FIG. 3 is a plan view illustrating a V-shaped engine mounted on a frame of the dump truck according to the exemplary embodiment.
Figure 4:
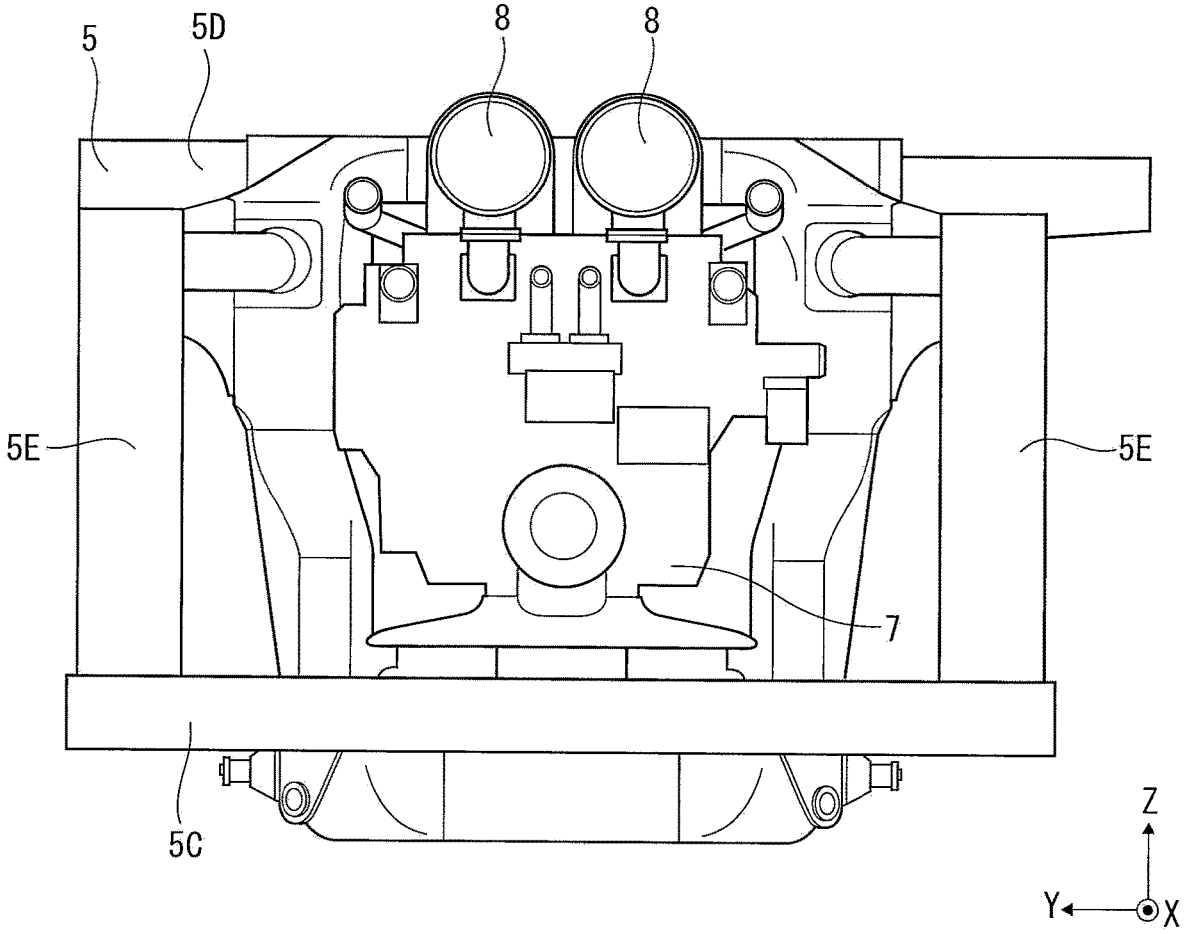
FIG. 4 is a front elevational view illustrating the V-shaped engine mounted on the frame of the dump truck according to the exemplary embodiment.
Figure 5:
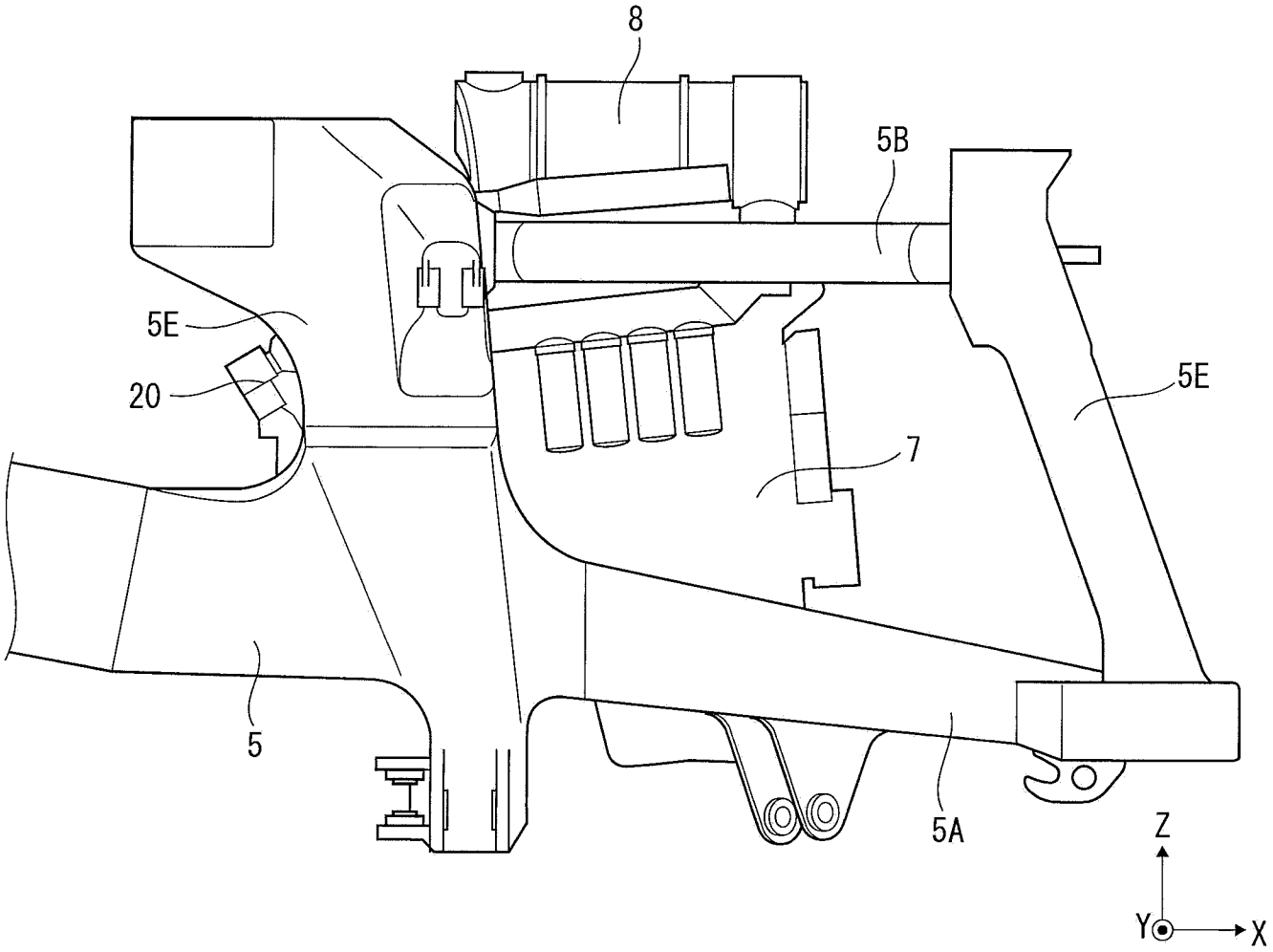
FIG. 5 is a side elevational view illustrating the V-shaped engine mounted on the frame of the dump truck according to the exemplary embodiment.

Each of FIGS. 3 to 5 illustrates a V-shaped engine 7 mounted on the frame 5 of the chassis 2. FIG. 3 is a plan view illustrating the V-shaped engine 7, FIG. 4 is a front elevational view illustrating the V-shaped engine 7 and FIG. 5 is a side elevational view illustrating the V-shaped engine 7.

The frame 5 includes: a pair of lower side members 5A and a pair of upper side members 5B each extending along the chassis 2 in the travel direction; a pair of lower cross members 5C and a pair of upper cross members 5D each extending along the chassis 2 in the width direction; and four vertical members 5E arranged in the vertical direction with respect to the ground.

The vertical members 5E respectively connect the lower side members 5A and the upper side members 5B. Each of the lower cross members 5C connects lower ends of the vertical members 5E. Each of the upper cross members 5D connects upper ends of the vertical member 5E. The pair of vertical members 5E, the lower cross members 5C and the upper cross members 5D constitute a gate-shaped frame.

2. Structure of EGR Apparatus 20

Figure 6:
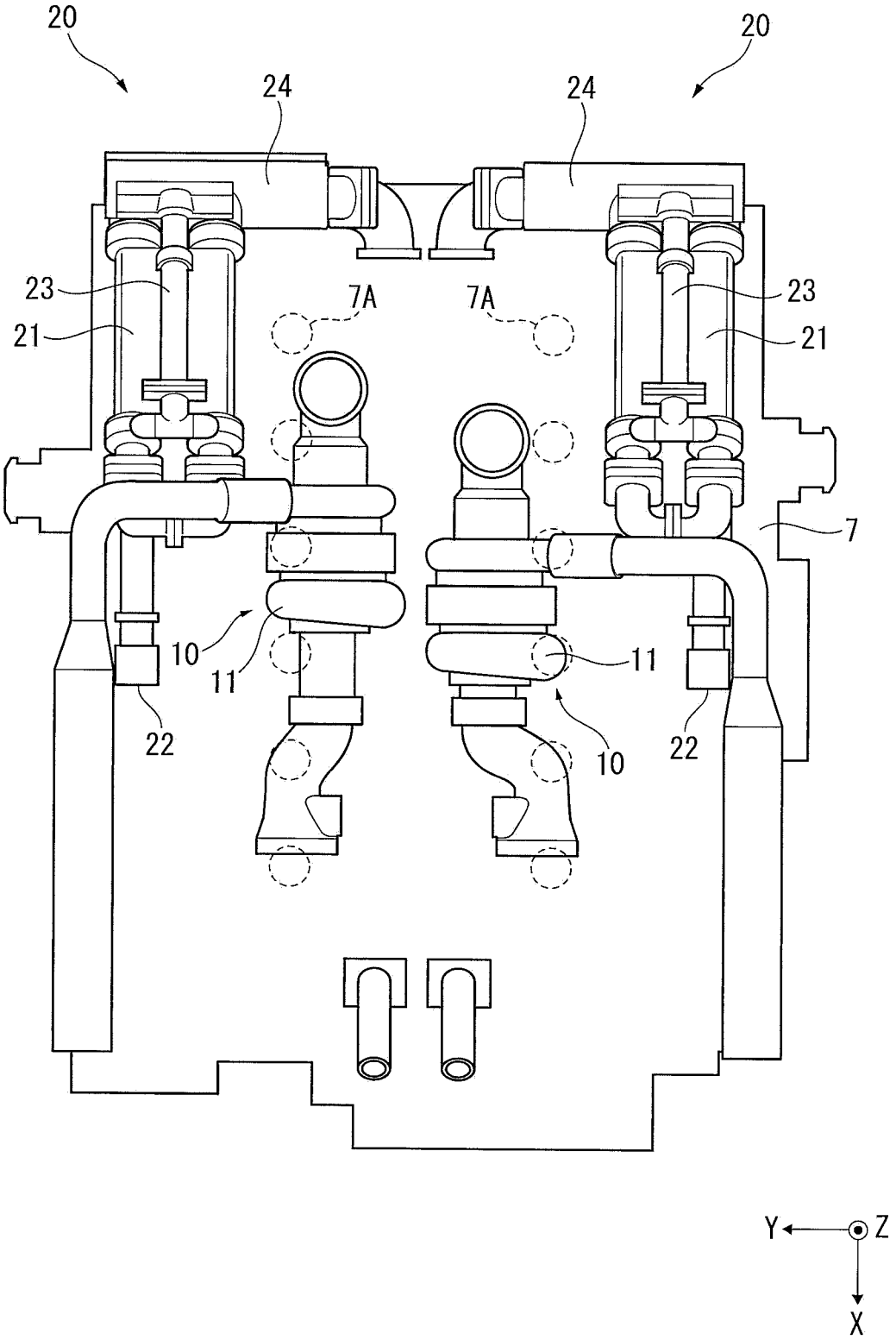
FIG. 6 is a plan view illustrating the V-shaped engine, a variable geometry turbo (VGT), and an EGR apparatus according to the exemplary embodiment.
Figure 7:
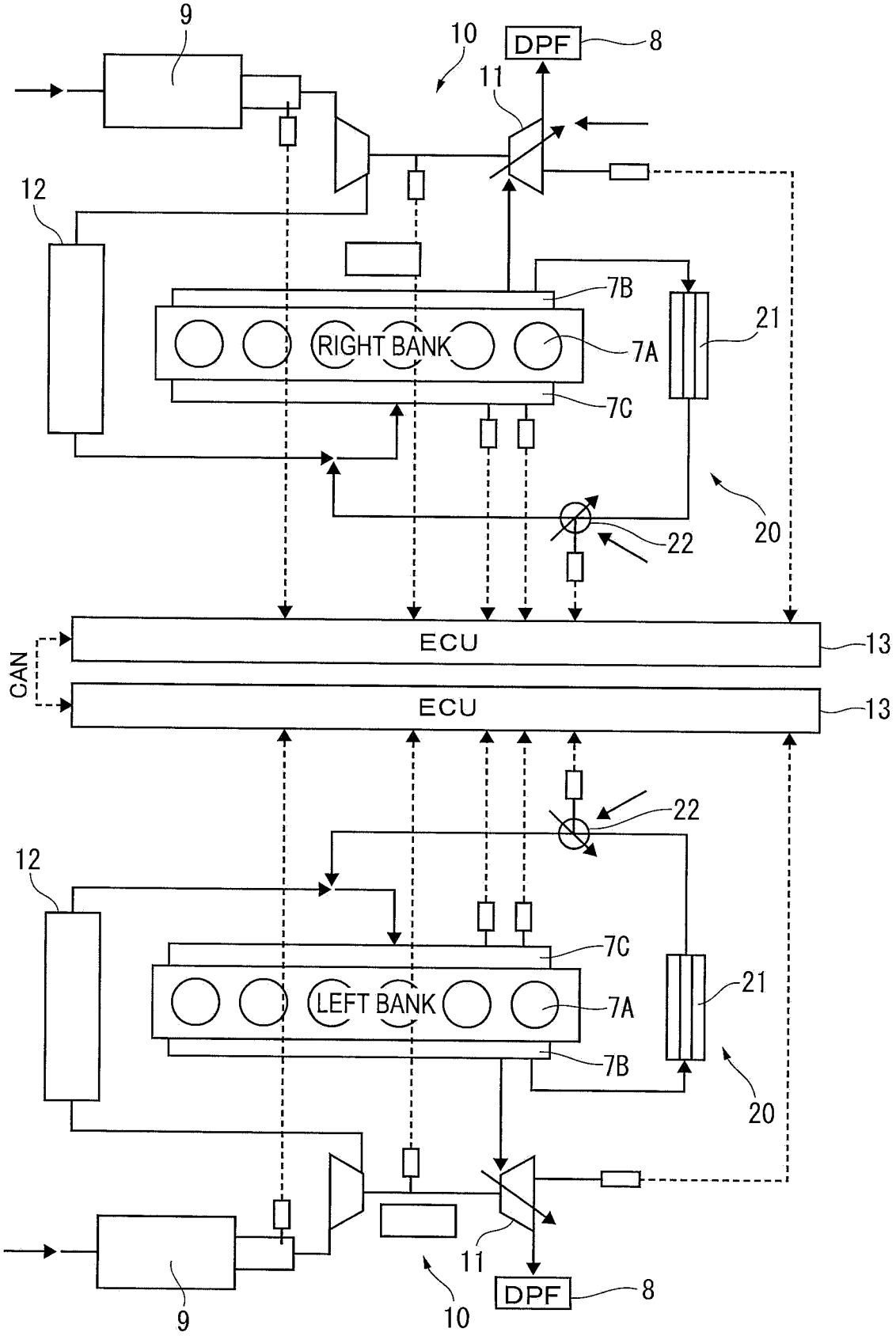
FIG. 7 is a schematic view illustrating the VGT and the EGR apparatus according to the exemplary embodiment.
Figure 8:
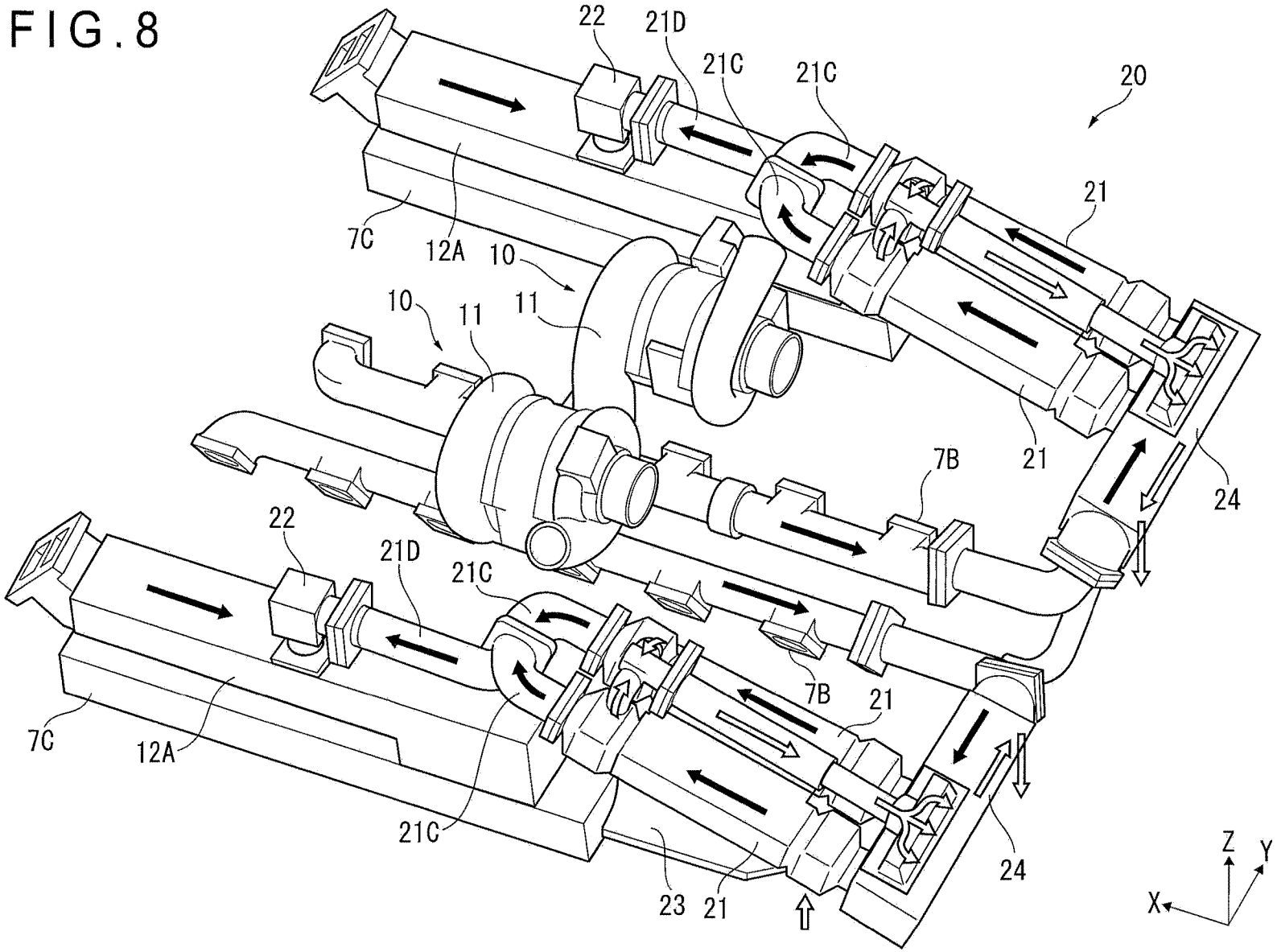
FIG. 8 is a perspective view illustrating the EGR apparatus according to the exemplary embodiment.

Each of FIG. 6 to FIG. 8 illustrates a variable geometry turbo (VGT) 10 disposed on the V-shaped engine 7 and an EGR apparatus 20. FIG. 6 is a plan view illustrating the V-shaped engine 7 from which an exhaust gas aftertreatment device 8 is removed. FIG. 7 is a schematic view illustrating the VGT 10 and the EGR apparatus 20. FIG. 8 is a perspective view illustrating the VGT 10 and the EGR apparatus 20 assembled to each other.

According to this exemplary embodiment, the VGT 10 and the EGR apparatus 20 are separately provided for each cylinder line 7A of the V-shaped engine 7 (see FIG. 7).

As shown in FIG. 7, the V-shaped engine 7 includes the cylinder lines 7A arranged in series on left and right sides in the width direction of the dump truck 1. The V-shaped engine 7 is housed in the gate-shaped frame 5. Each of the cylinder lines 7A of the V-shaped engine 7 is provided with an exhaust manifold 7B and an intake manifold 7C. The exhaust manifold 7B is a pipe conduit configured to bring together the exhaust gas in order to discharge the exhaust gas from a combustion chamber of the V-shaped engine 7. The intake manifold 7C is a branched pipe conduit in order to introduce air to the combustion chamber of the V-shaped engine 7.

An exhaust gas aftertreatment device 8 and the EGR apparatus 20 are disposed on the V-shaped engine 7. The exhaust gas aftertreatment device 8 and the EGR apparatus 20 are sized to be within a projection plane of the V-shaped engine 7 as viewed from the above (see FIG. 3).

The exhaust gas aftertreatment device 8 includes a cylindrical case and a Diesel Particulate Filter (DPF) housed in the cylindrical case, and is disposed to correspond to each pair of cylinder lines 7A of the V-shaped engine 7. The DPF is configured to collect particle matters in the exhaust gas passing therethrough. An oxidation catalyst may be provided at an upstream side of the DPF in the case. The oxidation catalyst oxidizes and activates post-injection fuel and dosing fuel (both equivalent to fuel of diesel engine) supplied at the upstream side, and increases a temperature of the exhaust gas to be introduced into the DPF to a regenerable temperature of the DPF. The exhaust gas at the high temperature causes self-combustion and disappearance of the particle matters collected by the DPF, thereby regenerating the DPF.

The VGT 10 compresses air supplied from an air cleaner 9, and supplies the compressed air to the intake manifold 7C of each of the cylinder lines 7A of the V-shaped engine 7. The VGT 10 includes an exhaust gas turbine 11, an aftercooler 12, and an Engine Control Unit (ECU) 13.

The VGT 10 includes the exhaust gas turbine 11 disposed at an exhaust line, and a compressor connected to the exhaust gas turbine 11 through a rotation shaft and disposed at an intake line. The exhaust gas turbine 11 is rotated by the exhaust gas discharged from the exhaust manifold 7B of the V-shaped engine 7, and in conjunction with this rotation, the compressor is rotated to compress air in the intake line.

The aftercooler 12 has a function of lowering a temperature of the air compressed by the exhaust gas turbine 11 to increase air density, thereby securing an amount of the air to be supplied to the intake manifold 7C.

As shown in FIG. 7, the ECU 13 is a controller configured to control the VGT 10 as a whole, and provided for each of the cylinder lines 7A of the V-shaped engine 7. The ECUs 13 are connected to each other in a communicatable manner through a Control Area Network (CAN), and controlled to operate together at the time of driving the V-shaped engine 7.

Figure 9:
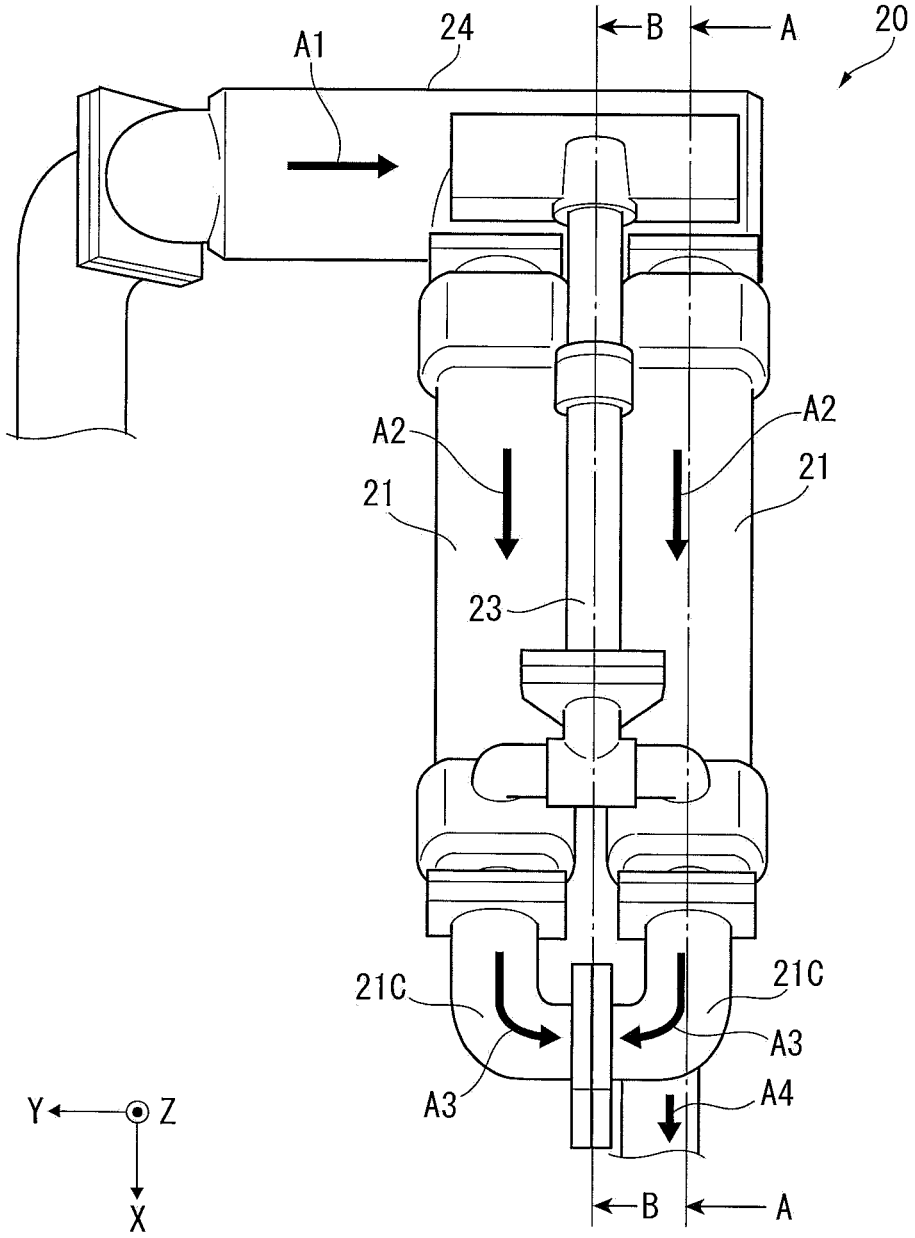
FIG. 9 is a plan view illustrating the EGR apparatus according to the exemplary embodiment.

As shown in FIGS. 7 to 9, the EGR apparatus 20 is configured to recirculate a part of the exhaust gas discharged from the exhaust manifold 7B of the V-shaped engine 7 to the intake manifold 7C to cause recombustion of the exhaust gas, thereby decreasing an amount of discharged NOx.

Specifically, as shown in FIG. 8, the EGR apparatus 20 includes EGR coolers 21, EGR valves 22, brackets 23 and exhaust gas connectors 24.

The EGR coolers 21 are disposed at two positions in the downstream side from the exhaust manifold 7B of each of the cylinder lines 7A of the V-shaped engine 7 and configured to branch the exhaust gas discharged from the V-shaped engine 7 and cool the exhaust gas.

Figure 10:
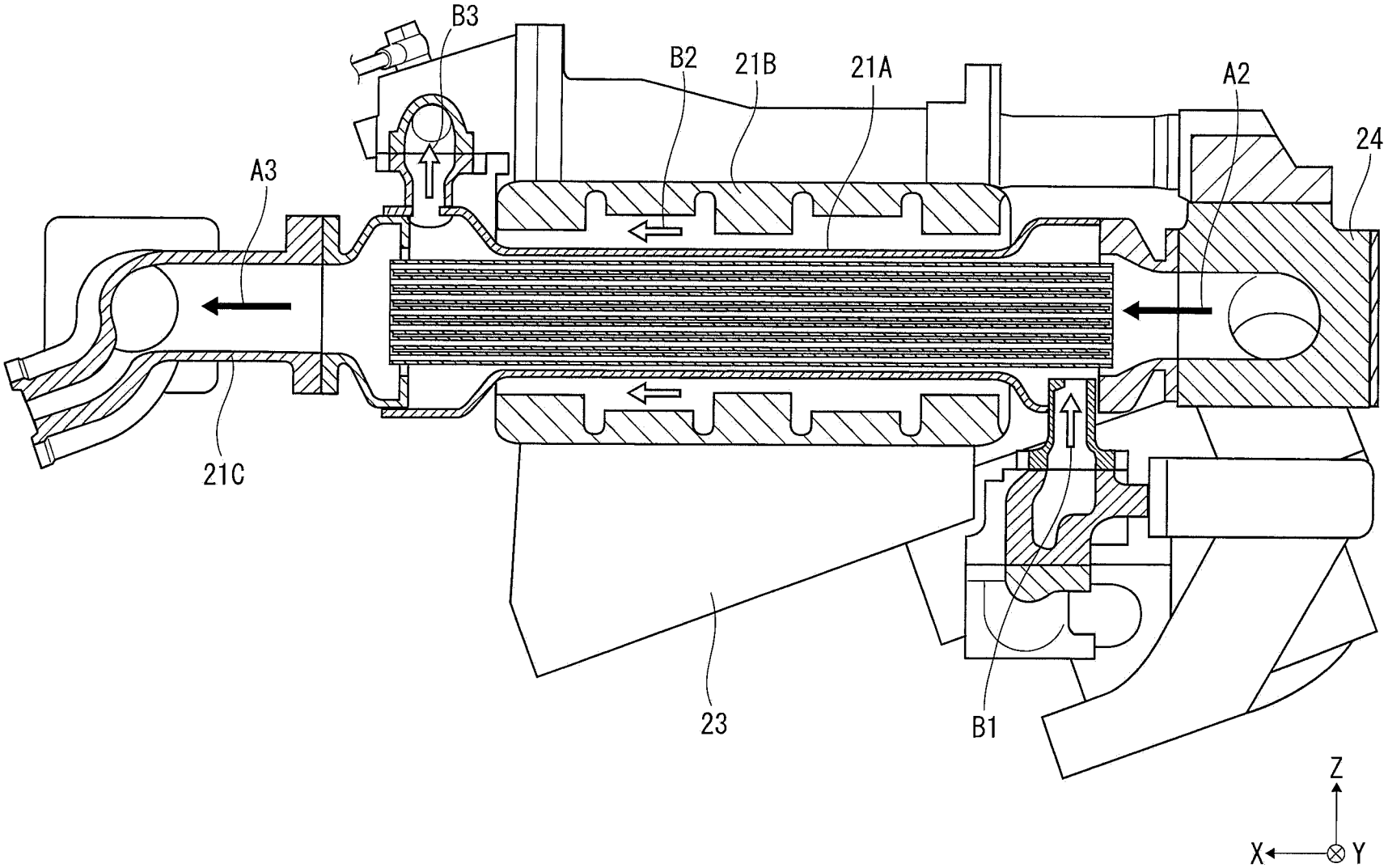
FIG. 10 is a cross-sectional view illustrating an EGR cooler taken along a line A-A in FIG. 9.

Specifically, as shown in FIG. 10 as a cross-sectional view taken along a line A-A in FIG. 9, each of the EGR coolers 21 includes an inner tube 21A, an outer tube 21B and an elbow tube 21C. The exhaust gas flows inside the inner tube 21A, and the cooling water flows in a space between the inner tube 21A and the outer tube 21B, so that heat exchange is performed between the exhaust gas and the cooling water, thereby cooling the exhaust gas.

The cooled exhaust gas joins together at the elbow tube 21C, and further joins together through the pipe 21D at the pipe 12A led to the intake manifold 7C from the aftercooler 12 (see FIG. 8).

As shown in FIGS. 7 and 8, each of the EGR valves 22 is disposed at the upstream side of the intake manifold 7C of each of the cylinder lines 7A of the V-shaped engine 7 and configured to be changed in an open degree to adjust the amount of the exhaust gas to be supplied to the intake manifold 7C.

As shown in FIGS. 8 and 9, each of the brackets 23 is a member configured to fix the EGR cooler 21 to the V-shaped engine 7 (not shown in FIGS. 8 and 9). The cooling water flows inside the bracket 23.

Figure 11:
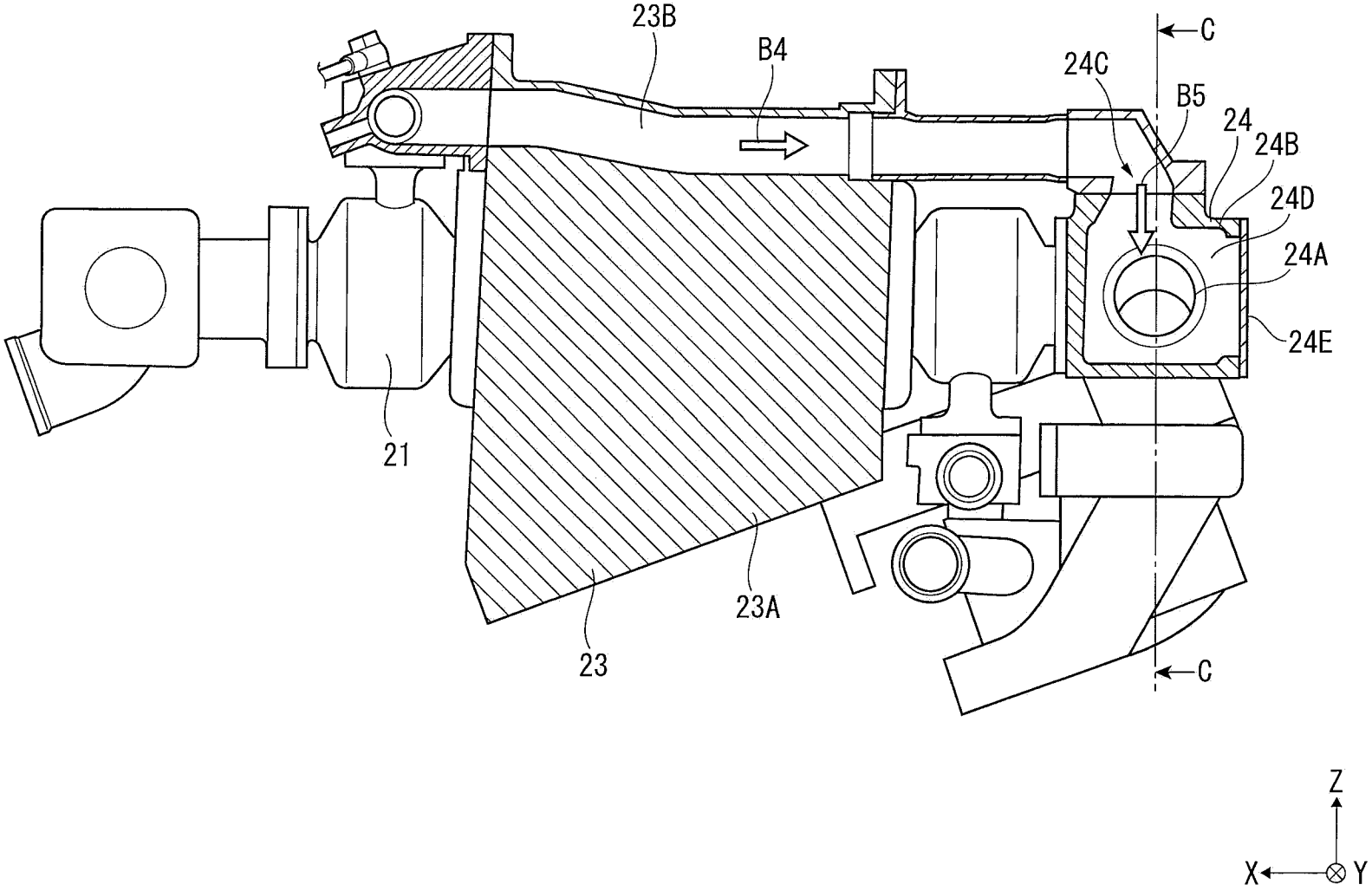
FIG. 11 is a cross-sectional view illustrating a bracket taken along a line B-B in FIG. 9.

Specifically, as shown in FIG. 11 as a cross-sectional view taken along a line B-B in FIG. 9, the bracket 23 includes a fixed portion 23A that is fixed to the V-shaped engine 7 and a cooling water path 23B formed integrally with an upper part of the fixed portion 23A. The cooling water of the EGR cooler 21 is supplied to the cooling water path 23B.

The reason why the cooling water path 23B is provided to the bracket 23 as described above is that the cooling water of the EGR cooler 21 is supplied to the cooling water path 23B of the bracket 23 to decrease a temperature difference between the EGR cooler 21 and the bracket 23 and prevent generation of heat stress between the EGR cooler 21 and the bracket 23.

A downstream-side end of the cooling water path 23B of the bracket 23 is connected to the exhaust gas connector 24.

The exhaust gas connector 24 includes a cooling water path 24D to which the cooling water for cooling the exhaust gas flowing inside the exhaust gas connector 24 is supplied. The exhaust gas connector 24 establishes communication between the exhaust manifold 7B and the EGR cooler 21 and is configured to cool the exhaust gas discharged from the exhaust manifold 7B and supply the cooled exhaust gas to the EGR cooler 21.

Specifically, as shown in FIG. 12 as a cross-sectional view taken along a line C-C in FIG. 11, the exhaust gas connector 24 includes an inner tube 24A, an outer tube 24B and cooling water introduction holes 24C. A space between the inner tube 24A and the outer tube 24B is defined as the cooling water path 24D. A downstream-side end of the cooling water path 23B of the bracket 23 is connected to the cooling water introduction holes 24C.

The inner tube 24A is a cylindrical metal pipe disposed inside the outer tube 24B. An upstream side of the inner tube 24A is connected to the exhaust manifold 7B of the V-shaped engine 7 through the pipe 24F located at the right side of the inner tube 24A. A downstream-side end of the inner tube 24A is connected to the inner tube 21A of the EGR cooler 21.

Figure 13:
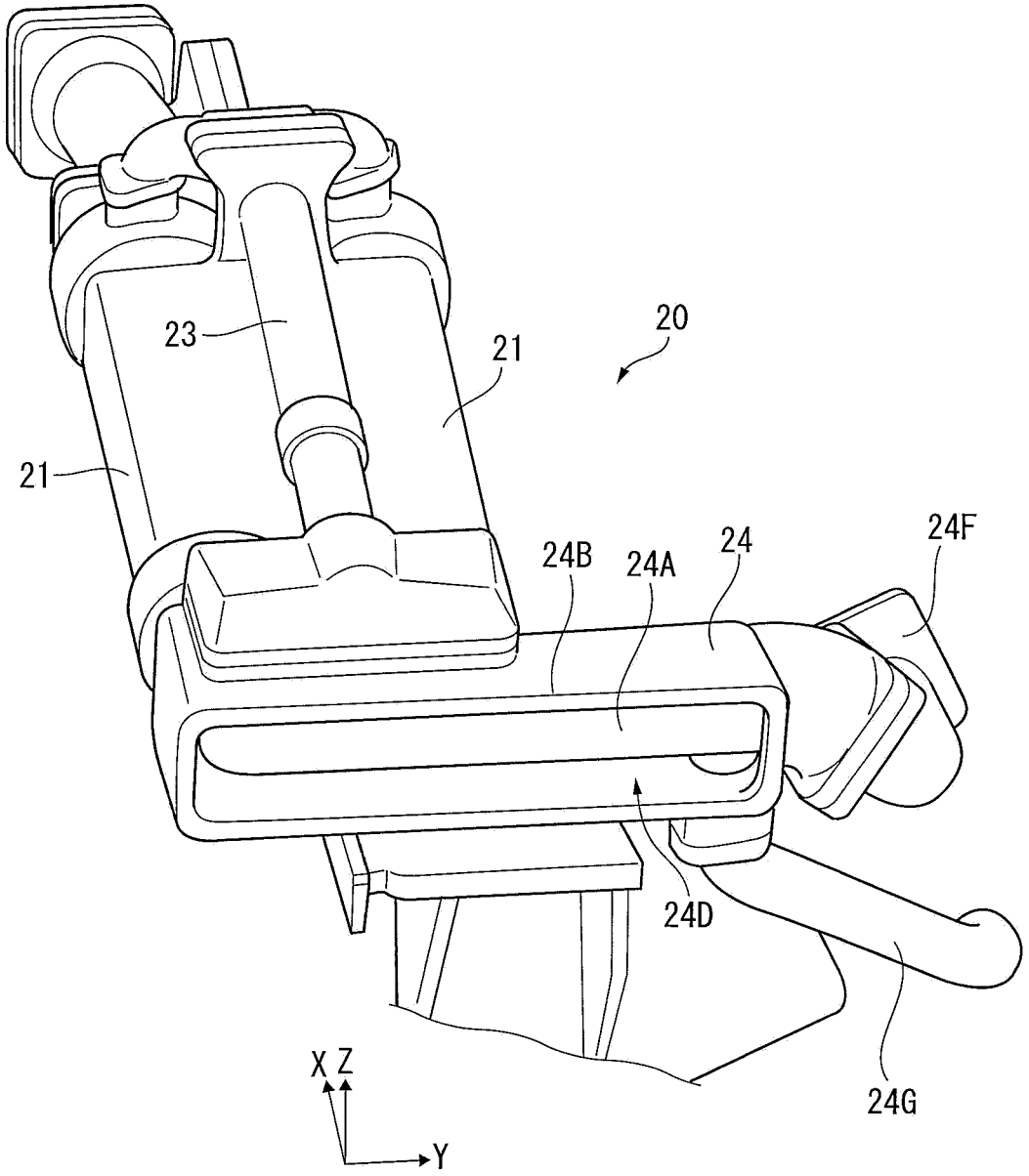
FIG. 13 is a perspective view illustrating a structure of each of the EGR cooler, bracket and exhaust gas connector according to the exemplary embodiment.
Figure 14:
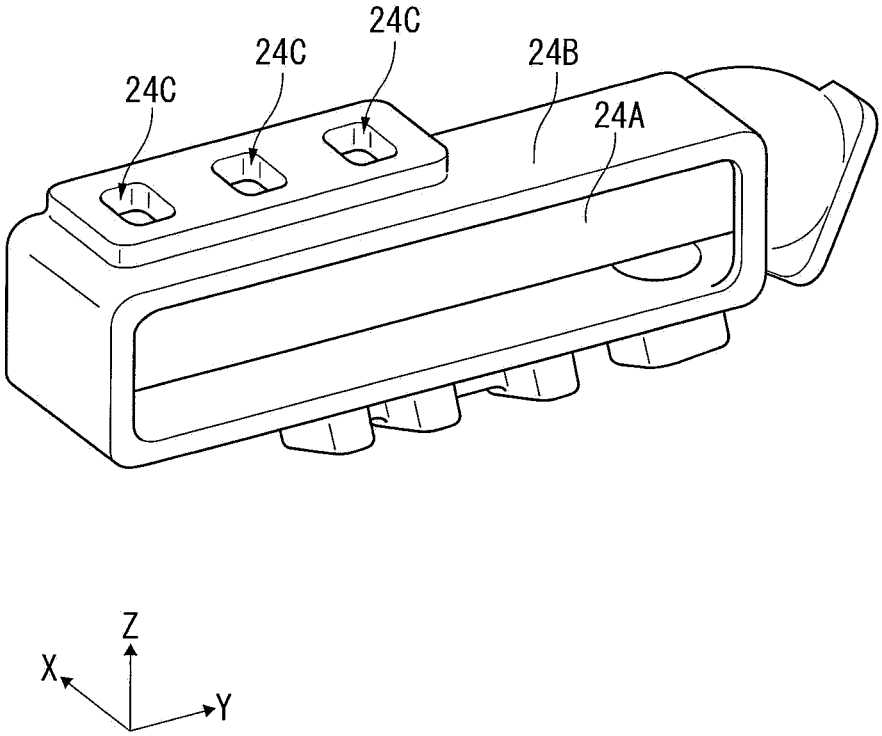
FIG. 14 is a perspective view illustrating an internal structure of the exhaust gas connector according to the exemplary embodiment.

As shown in FIGS. 13 and 14, the outer tube 24B is a steel member having a box shape whose front face is opened. Although not shown in FIGS. 13 and 14, the cooling water path 24D is covered with a lid member 24E (see FIG. 11) to be hermetically sealed.

The cooling water introduction holes 24C are disposed at three positions on the upstream side of the outer tube 24B. The cooling water introduction holes 24C are connected to the cooling water path 23B of the bracket 23. A downstream-side end of the outer tube 24B is connected to a pipe 24G through which the cooling water is discharged.

3. Flow of Exhaust Gas and Cooling Water

Next, flow of the exhaust gas and the cooling water in the EGR apparatus 20 of this exemplary embodiment is described by referring to FIGS. 8 to 12.

As shown in FIG. 8, the exhaust gas discharged from the exhaust manifold 7B of the V-shaped engine 7 flows along the direction indicated by black arrows in FIG. 8, passes through the inner tube 24A of the exhaust gas connector 24 (i.e., Flow A1 shown in FIGS. 9 and 12) and is supplied to the EGR coolers 21 (i.e., Flow A2 shown in FIGS. 9 and 10). The exhaust gas supplied to the EGR coolers 21 passes through the inner tube 21A (i.e., Flow A3 shown in FIGS. 9 and 10) and joins together at the elbow tube 21C (i.e., Flow A4 shown in FIG. 9). Further, the exhaust gas joins together at the intake line from the aftercooler 12 while the supply amount of the exhaust gas is adjusted using the EGR valve 22, and is supplied to the intake manifold 7C.

In contrast, the cooling water flows along the direction indicated by white arrows in FIG. 8, and is supplied to the EGR coolers 21 using a pump or the like (i.e., Flow B1 shown in FIG. 10). Further, the cooling water flows along the flow of the exhaust gas toward the upstream side of the V-shaped engine 7 to cool the exhaust gas (i.e., Flow B2 shown in FIG. 10).

Next, the cooling water is supplied to the cooling water path 23B of the bracket 23 through the downstream-side end of the EGR cooler 21 (i.e., Flow B3 shown in FIG. 10). Subsequently, the cooling water is supplied through the cooling water introduction holes 24C of the exhaust gas connector 24 connected to the downstream-side end of the cooling water path 23B to the inside of the cooling water path 24D of the exhaust gas connector 24 (i.e., Flows B4 and B5 shown in FIG. 11). The heat exchange is performed between the cooling water and the exhaust gas discharged from the exhaust manifold 7B in the exhaust gas connector 24, so that the exhaust gas is cooled (i.e., Flow B6 shown in FIG. 12).

Lastly, the cooling water which has cooled the inner tube 24A of the exhaust gas connector 24 is supplied from the pipe 24G to a cylinder block of the V-shaped engine 7 (i.e., Flow B7 shown in FIG. 12).

4. Advantage(s) of Embodiment(s)

According to this exemplary embodiment, since the exhaust gas connector 24 includes the cooling water path 24D and the exhaust gas can be cooled by the EGR cooler 21 after the exhaust gas discharged from the exhaust manifold 7B is cooled, it is possible to cool the exhaust gas efficiently.

Since the EGR apparatuses 20 are disposed so as to correspond to the cylinder lines 7A of the V-shaped engine 7, it is possible to efficiently cool the exhaust gas discharged from the cylinder lines 7A of the two EGR apparatuses 20 without enlarging the size of each of the EGR apparatuses 20.

5. Modification of Embodiment(s)

It should be appreciated that the scope of the invention is not limited to the above-described exemplary embodiment(s) but includes modifications and improvements as long as such modifications and improvements are compatible with the invention.

For instance, although the invention is applied to the rigid dump truck 1 in the above exemplary embodiment, the invention is also applicable to an articulated dump truck, and other working vehicles such as a wheel loader.

Further, according to the above exemplary embodiment, the cooling water used in the EGR cooler 21 is supplied to the cooling water path 23B of the bracket 23 to increase the temperature of the bracket 23, and then supplied to the cooling water path 24D of the exhaust gas connector 24. However, the invention is not limited thereto. For instance, the cooling water used in the EGR cooler 21 may be directly supplied to the cooling water path 24D of the exhaust gas connector 24.

Further, the specific arrangements and configurations may be altered in any manner as long as the modifications and improvements are compatible with the invention.

The invention claimed is:

1. An exhaust gas recirculation (EGR) apparatus configured to circulate exhaust gas discharged from an exhaust manifold of an engine to an intake manifold of the engine, the EGR apparatus comprising:

an EGR cooler disposed at a downstream side from the exhaust manifold and configured to cool the exhaust gas discharged from the exhaust manifold;

an EGR valve disposed at an upstream side from the intake manifold and configured to adjust an amount of the exhaust gas to be supplied to the intake manifold;

an exhaust gas connector that is attached to the exhaust manifold and that establishes communication between the EGR cooler and the exhaust manifold; and a bracket used to attach the EGR apparatus to the engine, wherein the bracket comprises a cooling water path into which cooling water having passed through the EGR cooler is supplied directly from the EGR cooler, the exhaust gas connector is supplied directly from the bracket with the cooling water that has passed through the bracket, the cooling water path of the bracket comprises a first end directly connected to the EGR cooler and a second end directly connected to the exhaust gas connector, and the cooling water path is configured to deliver the cooling water sequentially from the EGR cooler, through the bracket and the exhaust gas connector, to a cylinder block of the engine.

2. A dump truck comprising the EGR apparatus according to claim 1.

3. The dump truck according to claim 2, wherein the EGR apparatus is sized to be within a projection plane of the engine as viewed from vertically above the engine.

* * * * *